US008469215B2

(12) United States Patent
Giesbers

(10) Patent No.: US 8,469,215 B2
(45) Date of Patent: Jun. 25, 2013

(54) COLLAPSIBLE FREIGHT CONTAINER

(75) Inventor: Rene Giesbers, Ridderkerk (NL)

(73) Assignee: Cargoshell Holding B.V., Rotterdam (NL)

( * ) Notice: Subject to any disclaimer, the term of this patent is extended or adjusted under 35 U.S.C. 154(b) by 0 days.

(21) Appl. No.: 13/255,008

(22) PCT Filed: Mar. 12, 2010

(86) PCT No.: PCT/NL2010/000038

§ 371 (c)(1),
(2), (4) Date: Sep. 28, 2011

(87) PCT Pub. No.: WO2010/104378

PCT Pub. Date: Sep. 16, 2010

(65) Prior Publication Data

US 2012/0061390 A1 Mar. 15, 2012

(30) Foreign Application Priority Data

Mar. 13, 2009 (NL) ..... 1036708

(51) Int. Cl.
*B65D 88/52* (2006.01)

(52) U.S. Cl.
USPC ..... 220/1.5; 220/6; 220/7

(58) Field of Classification Search
USPC ..... 220/1.5, 4.28, 4.29, 4.33, 4.34, 6, 220/7, 9.2, 9.3, 666; 292/97, 240, 194, 196, 292/229
See application file for complete search history.

(56) References Cited

U.S. PATENT DOCUMENTS 3,612,330 A * 10/1971 Baer ..... 220/1.5
3,765,556 A * 10/1973 Baer ..... 220/1.5
4,214,669 A * 7/1980 McQuiston ..... 220/6
4,314,686 A * 2/1982 Marz ..... 248/346.3
4,353,520 A * 10/1982 Jansson ..... 248/346.3
4,388,995 A * 6/1983 Ahn ..... 220/7

(Continued)

FOREIGN PATENT DOCUMENTS

CA 2091824 A * 9/1993
DE 2352117 A * 5/1974

(Continued)

OTHER PUBLICATIONS

International Search Report of PCT/NL2010/000038 dated Jun. 22, 2010.

*Primary Examiner* — Anthony Stashick
*Assistant Examiner* — Robert Stodola
(74) *Attorney, Agent, or Firm* — Rankin, Hill & Clark LLP

(57) ABSTRACT

A collapsible freight container includes a floor panel, a roof panel and two longitudinal side walls connected to the floor panel and the roof panel. Each side wall includes a first and a second part, which are connected by a hinged joint, such that the first part can hinge towards the second part of the same side wall about a hinge axis extending in the longitudinal direction of the freight container. Each corner of the freight container is provided with a corner pin. The corner pins can be moved simultaneously, using an unlocking mechanism, from a locked position, in which the side walls are rigidly connected to the roof panel and the floor panel by the corner pins, to an unlocked position, in which the side walls are hinged to the roof panel and the floor panel by the corner pins.

20 Claims, 7 Drawing Sheets

U.S. PATENT DOCUMENTS

| | | | | |
|---|---|---|---|---|
| 4,577,772 | A * | 3/1986 | Bigliardi | 220/1.5 |
| 4,630,746 | A * | 12/1986 | Fortenberry | 220/6 |
| 4,726,486 | A * | 2/1988 | Masuda | 220/1.5 |
| 4,848,618 | A * | 7/1989 | Yuan et al. | 220/1.5 |
| 7,296,704 | B2 * | 11/2007 | Ferrini | 220/1.5 |
| 2008/0135545 | A1 | 6/2008 | Sadkin et al. | |

FOREIGN PATENT DOCUMENTS

| | | | |
|---|---|---|---|
| DE | 3805981 | A * | 9/1989 |
| DE | 10219709 | A1 * | 11/2002 |
| EP | 0255194 | | 2/1988 |
| EP | 1277673 | | 1/2003 |

* cited by examiner

COLLAPSIBLE FREIGHT CONTAINER

The invention relates to a collapsible freight container comprising a floor panel, a roof panel as well as two longitudinal side walls connected to the floor panel and the roof panel, each longitudinal side wall comprising a first and a second part, which are connected by means of at least one hinged joint, such that the first part can hinge towards the second part of the same longitudinal side wall about a hinge axis extending in the longitudinal direction of the freight container.

These days, in the year 2009, the number of empty freight containers being transported as return freight is enormous. Considering the fact that an empty standard metal freight container takes up just as much space as a full one, this means that an enormous volume of empty containers is transported by conveying means. The transportation of such volumes of empty containers involves enormous cost, therefore. Furthermore, the transportation of said large volume of empty containers also constitutes an enormous burden on the environment.

A collapsible freight container as described above, which is known per se, in particular makes it possible to transport more containers at the same time as empty return transport. The volume required for an empty non-collapsible freight container to be transported suffices for accommodating at least four collapsible containers. This leads not only to an enormous saving in costs, because a particular transport volume is utilised more efficiently, but also to an enormously reduced burden on the environment, because less transport volume is required, for example in trucks, for return transport.

For the logistics industry it is a significant drawback of the known collapsible containers that in many cases collapsing and expanding of the freight containers cannot take place quickly and/or in a user-friendly manner. Relatively much time and a relatively large number of operations are often required for collapsing and expanding the known freight containers, so that so far the known collapsible containers have not, been used much, if at all, in the logistics industry.

The object of the present invention is therefore to provide a collapsible container which can be collapsed and expanded in an efficient and user-friendly manner.

This object is accomplished with the freight container according to the present invention in that each corner of the freight container is provided with at least one corner pin, which corner pins can be moved simultaneously, using an unlocking mechanism, from a locked position, in which the longitudinal side walls are rigidly connected to the roof panel and the floor panel of the freight container by means of said corner pins, to an unlocked position, in which the longitudinal side walls are hinged to the roof panel and the floor panel of the freight container by means of the corner pins.

By using a centrally controlled unlocking mechanism, all corner pins can be unlocked quickly and simultaneously in one operation. In the locked position of the corner pins, a collapsible freight container is provided which is comparable as regards robustness with conventional non-collapsible freight containers. In the unlocked position of the corner pins, the longitudinal side walls can hinge relative to the roof panel and the floor panel of the freight container. The longitudinal side walls hinge about three hinge axes extending in the longitudinal direction of the freight container, i.e. a first hinge axis extends substantially along the junction between the longitudinal side wall and the roof panel, a second hinge axis extends along an axial line of the longitudinal side wall, whilst a third hinge axis extends substantially along the junction between the longitudinal side wall and the floor panel.

In the unlocked position, the freight container can be simply folded to a compact, collapsed position, in which position the freight container can be stored or transported while using up a minimum amount of space.

The freight containers are preferably standard size containers, whose dimensions are usually indicated as "TEU" or "teu". "Teu" is the standard designation for the dimension of freight containers. One (1) teu equals a 20 ft (6.06 m) long freight container. Another standard dimension is a 40 ft freight container. Furthermore, 10 ft containers, in particular used for storage, and 45 ft ("high cube") containers, in particular used for overland transport, are also standard size freight containers.

An advantageous embodiment of the invention is characterised in that each end wall is a sectional door, which can be moved from a position in which it extends substantially transversely to the roof panel in the closed position of the freight container to a position in which it extends substantially parallel to the roof panel in the open position of the freight container, and vice versa.

A sectional door has the advantage that the end wall of the freight container can be opened and closed without the end wall swinging outwards. In this way the freight containers can be positioned closer together during storage and transport, whilst the contents of the freight containers will remain accessible for inspection via the sectional door even when the spacing between the freight containers is minimal.

In the collapsed position of the freight container, the sectional door extends parallel to the roof panel. The roof panel comprises a space above the longitudinal side walls, in which the sectional door can be accommodated. When the freight container is being folded to the collapsed position, the sectional door must be maximally open, in which position it extends substantially parallel to the roof panel of the freight container.

Another embodiment of the invention is characterised in that the unlocking mechanism is provided with a folding arm for folding the freight container to the collapsed position, which folding arm is pivot-mounted to the roof panel of the freight container and which, by pivoting through a predetermined acute angle, can move the corner pins from the locked position to the unlocked position.

All corner pins are simultaneously unlocked in a simple manner and in one operation by means of the folding arm by causing said folding arm to pivot.

Another embodiment of the invention is characterised in that the folding arm is connected via connecting means to at least the upper corner pins that connect the roof panel to the longitudinal side walls, which upper corner pins can be pivoted by means of the folding arm from the position they take up in the locked position to a folding position, in which folding position the freight container is at least partially collapsed.

Accordingly, not only are all the corner pins unlocked by means of the folding arm, but additionally at least the upper corner pins are pivoted by means of the folding arm, such that the freight container can be actively collapsed by means of the folding arm.

Yet another embodiment of the invention is characterised in that the freight container is furthermore provided with an extension arm on the roof panel of the freight container, which extension arm is connected at least to the upper corner pins via connecting means, which upper corner pins connect the roof panel to the longitudinal side walls, whilst the upper corner pins can be pivoted by means of the extension arm from a folding position, in which folding position the freight container is at least partially collapsed, to the position in the locked position.

The freight container can be folded out to the expanded position in a simple manner by means of the extension arm, which extension arm functions in exactly the reverse manner for expanding the freight container as the folding arm for collapsing the freight container.

The freight container can be collapsed or expanded in a simple, quick and reliable manner by controlling the folding arm or the extension arm.

Yet another embodiment of the invention is characterised in that a folding arm or an extension arm disposed on the roof panel can be engaged by means of a lifting mechanism, for example a hook of a fork-lift truck or a crane.

Not only are the corner pins locked or unlocked and/or pivoted by means of the lifting mechanism when the folding arm or the extension arm is being engaged and moved/pivoted upwards, but the lifting mechanism also carries the weight of the parts of the freight container that are to be folded in or out. The parts of the freight container that are to be folded in, i.e. the longitudinal side walls, the end walls and the roof panel of the freight container, are moved downwards towards the floor panel of the freight container by means of the lifting mechanism, in such a manner that the hinged parts of the freight container gradually hinge together during said movement. When the freight container is being expanded, the parts of the freight container that are to be folded out, i.e. the longitudinal side walls, the end walls and the roof panel of the freight container in this case as well, are moved upwards away from the floor panel of the freight container by means of the lifting mechanism, in such a manner that the hinged parts of the freight container gradually hinge open during said movement.

In a specific embodiment of the freight container according to the invention, the pivoting movement of the folding arm for unlocking the corner pins is transmitted by means of a control cable between the pivot pin of the folding arm and the corner pins, whilst the pivoting movement of the corner pins is effected by cables comprising connecting means, which are connected to a corner pin on the one hand and to a part of the folding arm or the extension arm that can be moved by means of a lifting mechanism on the other hand. Such a construction is user-friendly, because it is easy to use and wear resistant, and consequently relatively low-maintenance. The control cable functions as a brake cable.

Another embodiment of the invention is characterised in that the unlocking mechanism is provided with locking pawls which are movable against spring force for locking the corner pins, which pawls can be moved against said spring force for unlocking the corner pins.

Such centrally controlled locking pawls are reliable and inexpensive. The pawls, which can be moved against spring force, do not require an active locking mechanism, since the pawls will lock the corner pins automatically under the influence of spring force when the corner pins are pivoted back to the position they take up in the locked position when the freight container is being expanded.

Yet another embodiment of the invention is characterised in that the freight container is made of a composite material.

The advantage of a freight container made of a composite material is that composite material has a low specific mass (density). Because of the low weight of the freight container, folding the freight container in and out is easy, because the forces required for doing so are relatively low.

The freight container is preferably made of a composite material consisting mainly of glass fibre and a resin, so that such a freight container is stronger than the conventional metal containers whilst being two to three times lighter than a metal freight container. A reduction of the weight of (empty) freight containers leads to a further saving on transport costs and has a positive effect as regards the environmental burden of such transport.

The invention will be explained in more detail hereinafter on the basis of a possible embodiment of the freight container according to the invention which is schematically illustrated in the appended figures.

FIG. 1 is a perspective view of a part of a freight container according to the present invention;

FIGS. 2*a-d* are schematic views showing the way an expanded freight container shown in FIG. 2*a* is folded, via the step shown in FIG. 2*b*, to the collapsed position shown in FIG. 2*c*, which container can be folded out, via the step shown in FIG. 2*d*, into an expanded freight container according to the present invention as shown in FIG. 2*a;*

Like parts are indicated by the same numerals in the various figures.

Figure 1:
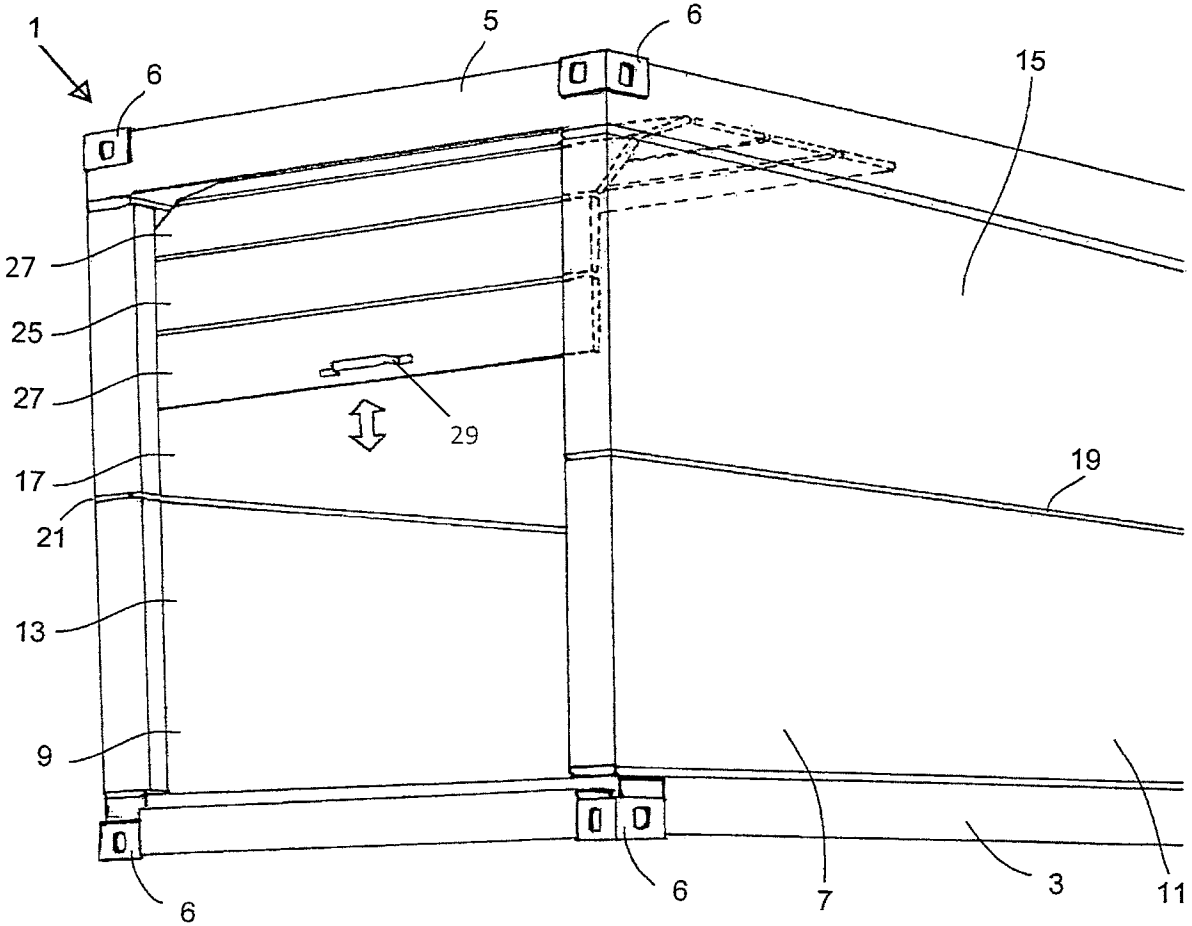

FIG. 1 is a perspective view of a part of a collapsible freight container 1 according to the present invention. The freight container 1 comprises a floor panel 3, a roof panel 5 as well as two longitudinal side walls 7, 9 hinged to the floor panel 3 and the roof panel 5. Each longitudinal side wall 7, 9 comprises a first part 11, 13 and a second part 15, 17, which are interconnected by means of a piano hinge 19, 21, such that a first part 11, 13 can hinge towards a second part 15, 17 of the same longitudinal side wall 9, 11 about a hinge axis 18, 20 extending in the longitudinal direction of the freight container.

Each end wall of the collapsible freight container 1 according to the present invention is a sectional door 25, which is built up of panels 27. The sectional door 25 is provided with a handle 29. By means of said handle 29, the sectional door 25 can be moved in rails (not shown) in the directions indicated by the arrow in FIG. 1 to a position substantially transversely to the roof panel 5 in the closed position of the freight container 1 or to a position substantially parallel to the roof panel 5 in the open position of the freight container 1, and vice versa. FIG. 1 shows a half-open position of the freight container 1.

To collapse the freight container 1, the two sectional doors 25 at the end walls of the freight container 1 must be completely open.

The outer corners of the roof panel 5 and the floor panel 3 of the freight container 1 are further strengthened with bumper means 6.

FIGS. 2*a-d* are schematic views of the collapsing and expanding of the freight container according to the present invention. Not all details are shown in the schematic views of FIGS. 2*a-d*.

Figures 2A, 2B, 2C, 2D:
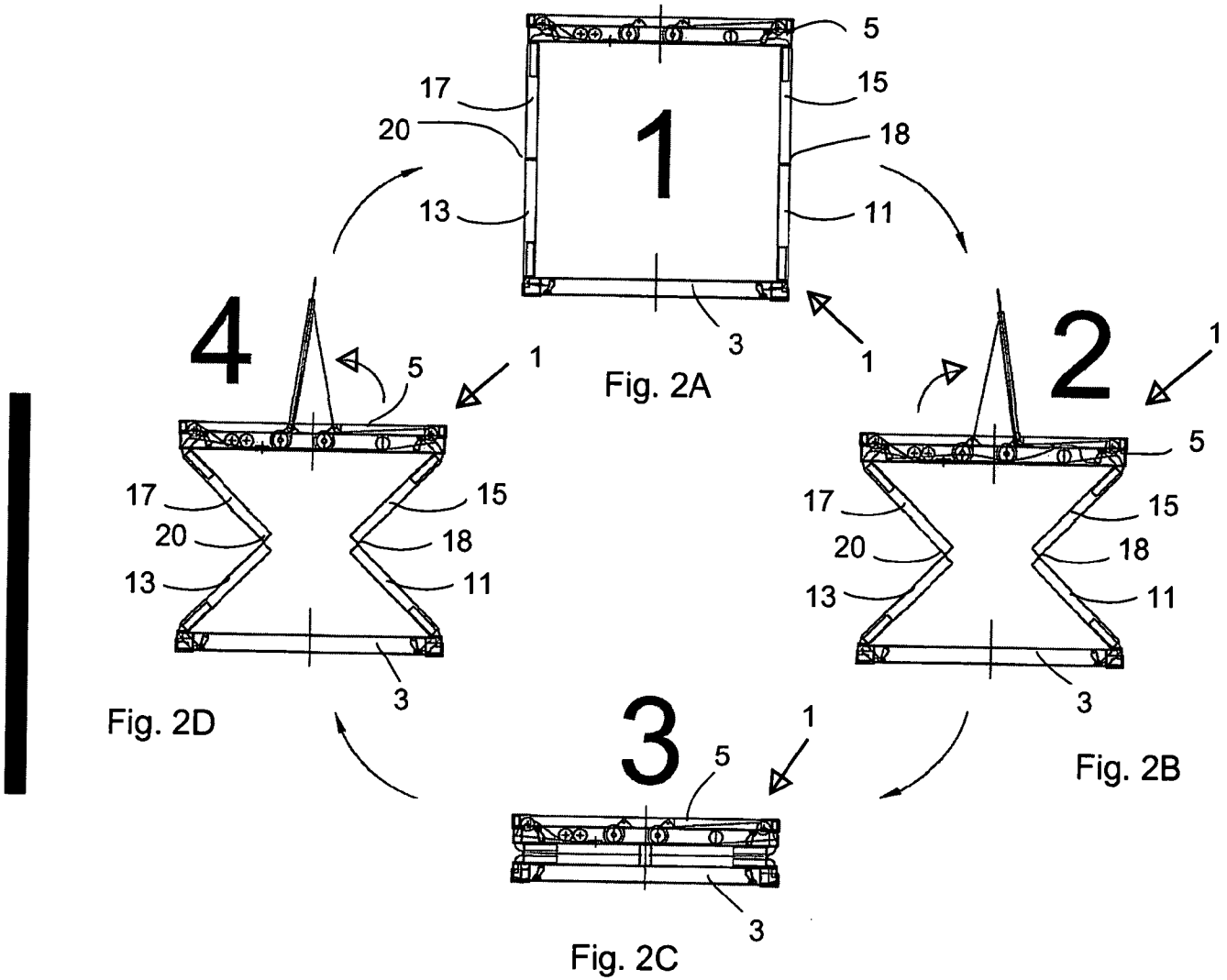
Figure 3:
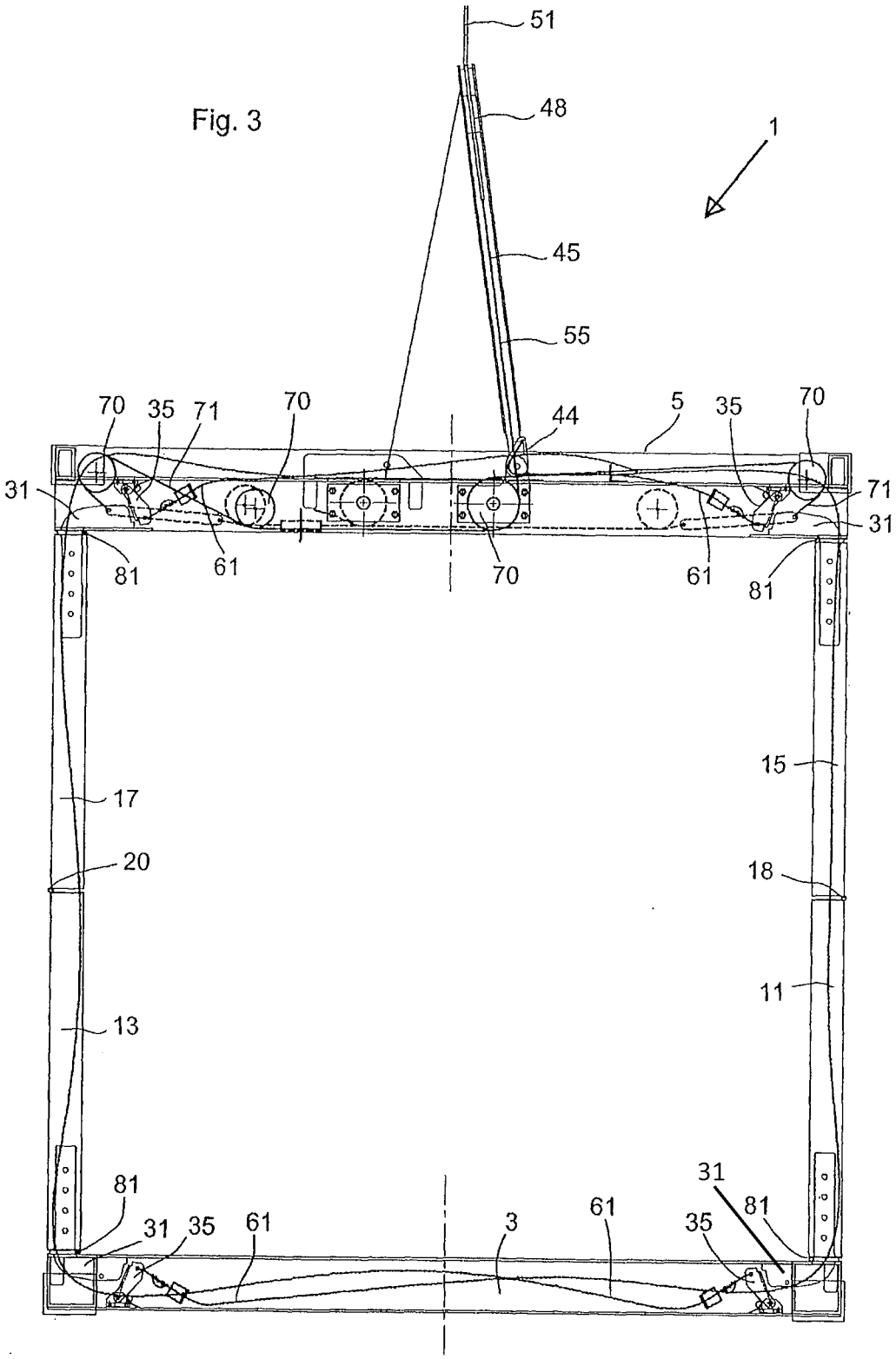
FIG. 3 is a schematic sectional view of a freight container according to the present invention, in which the mechanism for collapsing the freight container is shown.
Figure 4:
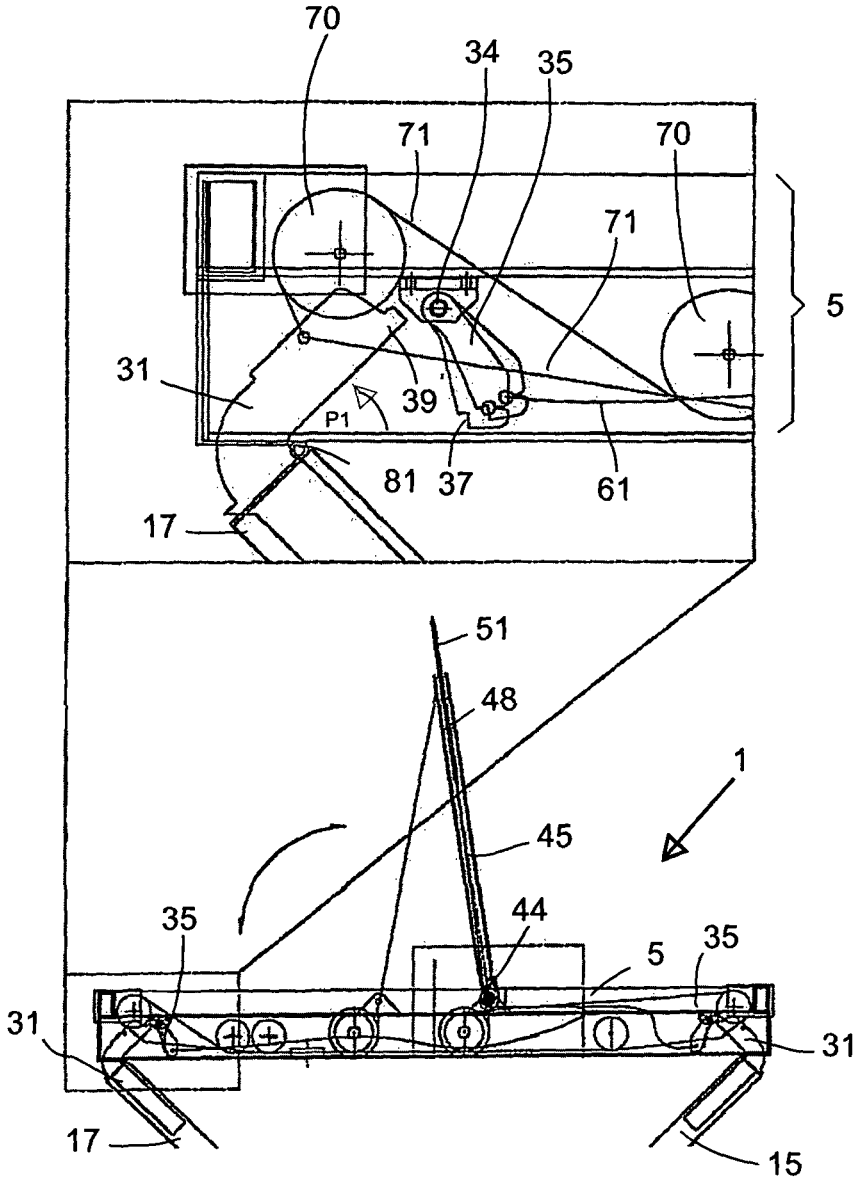
FIG. 4 shows in schematic sectional views, in which a section of the corner of the freight container is shown on a larger scale, the way in which corner pins are moved by means of the control mechanism for collapsing the freight container according to the present invention.
Figure 5:
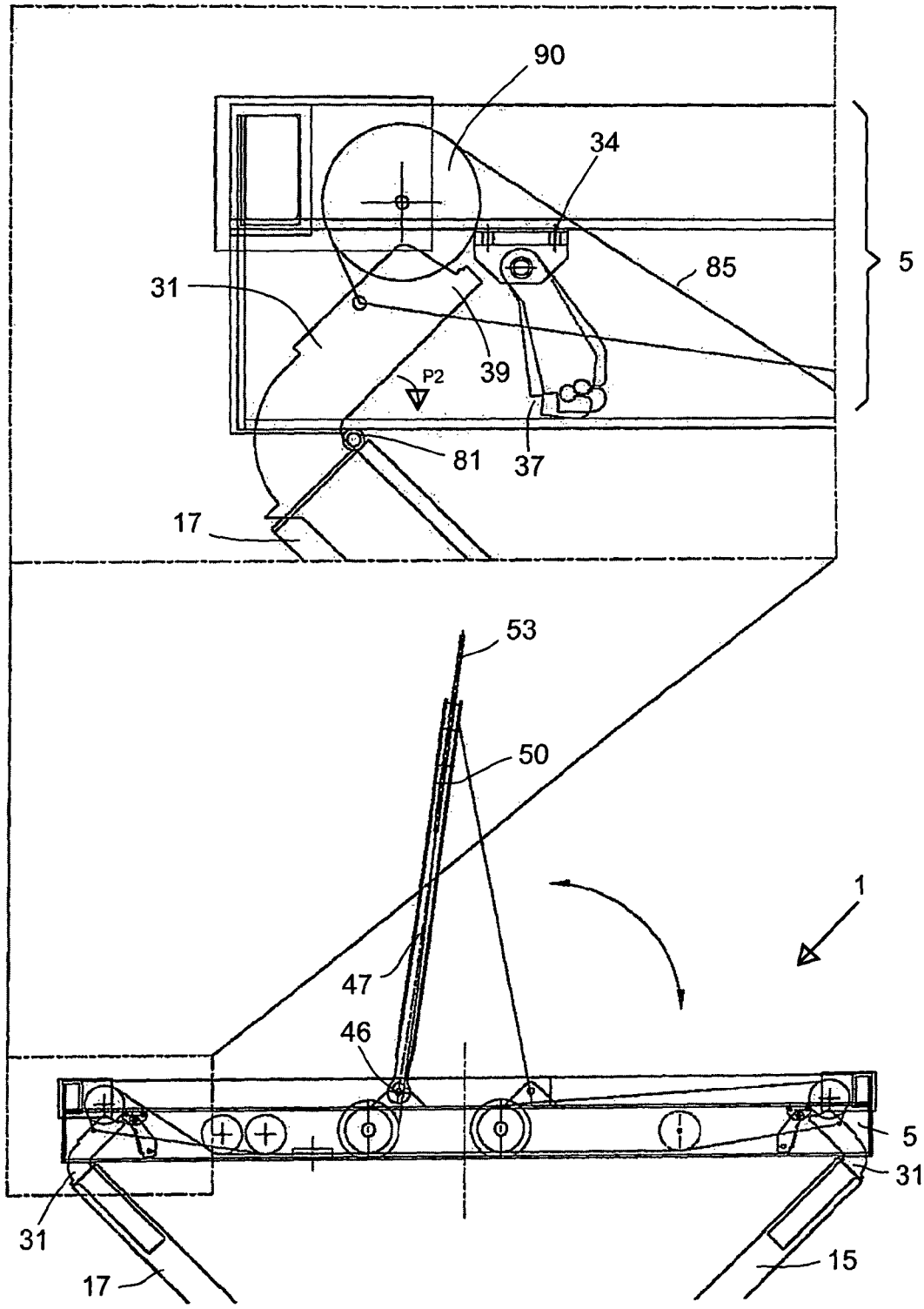
FIG. 5 shows in schematic sectional views, in which a section of the corner of the freight container is shown on a larger scale, the way in which corner pins are moved by means of the control mechanism for folding out the freight container according to the present invention to the expanded position.

FIG. 3 is a schematic sectional view corresponding to the view of the freight container 1 shown in FIG. 2*a*, in which the freight container 1 is about to be folded to the collapsed position. FIGS. 4 and 5 are larger-scale sectional views corresponding to the views of the freight container 1 in FIG. 2*b* and FIG. 2*d*, respectively. The view shown in FIG. 6 corresponds to the view of the expanded freight container 1 in FIG. 2*a*.

At least each corner near the end walls between the roof panel 5 or the floor panel 3 and the longitudinal side walls 7, 9 of the freight container 1 is provided with at least one corner pin 31. One part of each corner pin 31 is immovably fixed to the longitudinal side wall 7, 9 by fixing means, whilst the other part of each corner pin 31 is pivotally accommodated in the roof panel 5 or the floor panel 3 of the freight container.

The floor panel 3 and the roof panel 5 are provided with pawls 35 which are pivotable about a pivot pin 34 (FIGS. 4 and 5), which pawls can be pivoted against spring force from an inactive position (FIG. 6), in which they are connected to a corner pin 31 if the corner pin 31 is present at that location, to an active position (FIG. 3), in which they are disconnected from the corner pins 31 anyway. Each pawl 31 is provided with a recess 37 (FIGS. 4 and 5), which can be moved over a projection 39 of the corner pin 31 for locking the corner pin 31 in position in the expanded position (FIG. 6) of the freight container 1.

Figure 6:
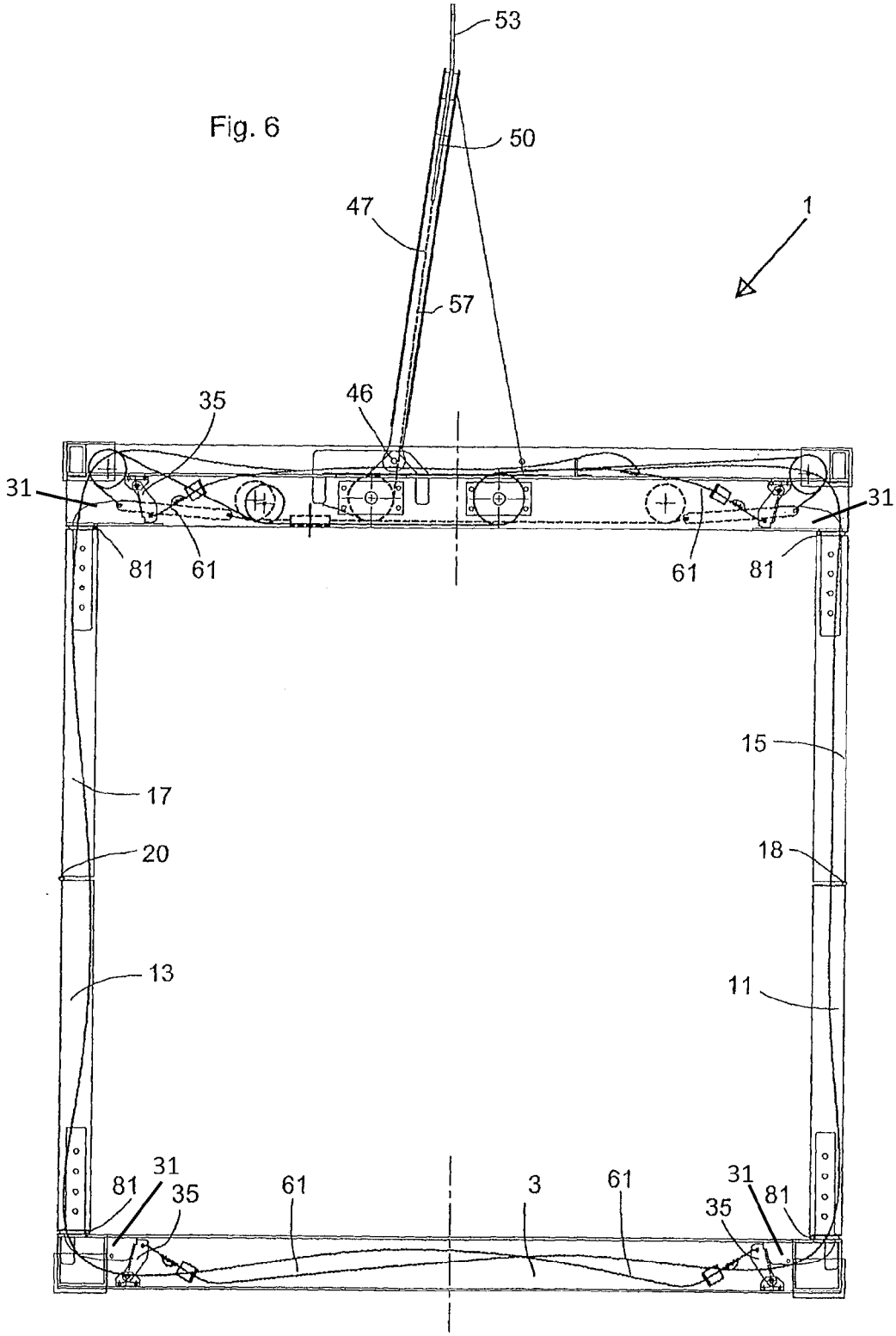
FIG. 6 is a schematic sectional view of an expanded freight container according to the present invention, in which the control mechanism for folding out the freight container is shown.

The freight container 1 further comprises a folding arm 45 and an extension arm 47 lying on the roof panel 5 in the inactive position, which arms are pivotable about pivot pins 44 and 46, respectively. The folding arm 45 shown in FIGS. 3 and 4 is used for folding a freight container 1 to the collapsed position, whilst the extension arm 47 shown in FIGS. 5 and 6 is used for folding out a freight container 1 from a collapsed position to an expanded position.

Figure 7:
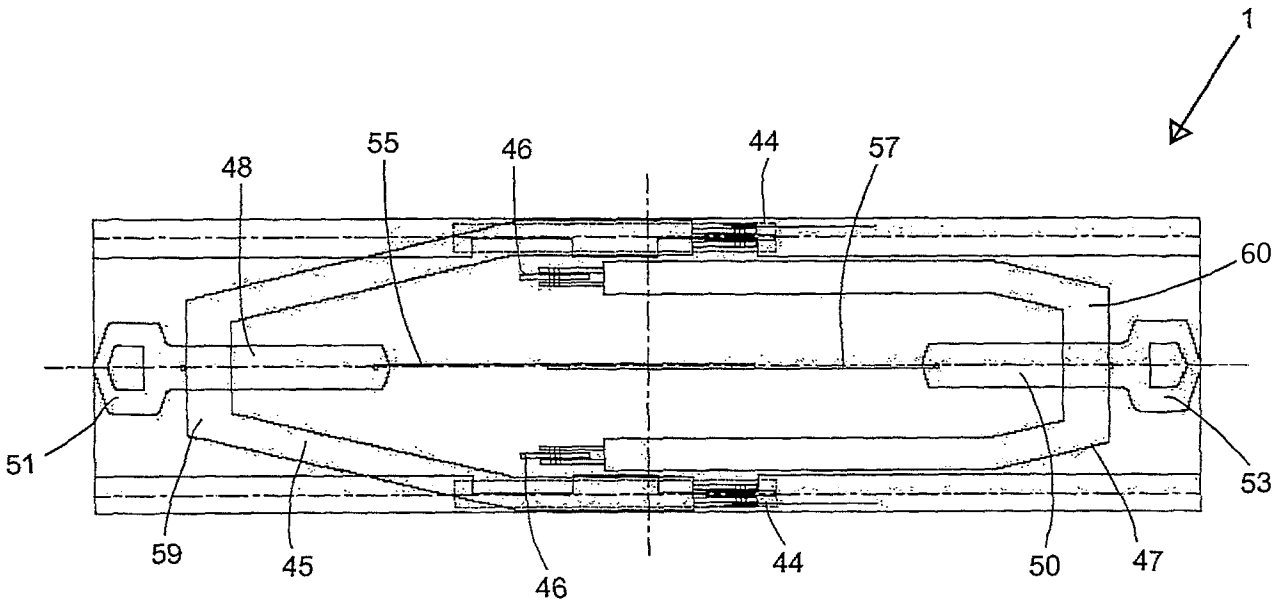
FIG. 7 is a top plan view of the freight container according to the present invention.

FIG. 7 shows a top plan view of the freight container 1. The pivotable folding arm 45 and the extension arms 47 both have a body 48, 50, which is provided with an eye 51, 53 at one end, in which a hook (not shown) of a lifting mechanism, for example a fork-lift truck or a crane, can be hooked. At the end of the body 48, 50 remote from the eye 51, 53, a connecting element in the form of a folding cable 55 and an extension cable 57, respectively, is fixed to the body 48, 50. The folding arm 45 and the extension arm 47 further comprise a U-shape 59, 60, whose legs are connected to the pivot pins 44, 46. The body 48, 50 is movably accommodated in the bridge portion of the U-shape 59, 60.

The folding arm 45 is different from the extension arm 47 in that the unlocking mechanism for unlocking the corner pins 31 is integrated in the pivot pin 44 of the folding arm 45. When the folding arm 45 has passed through a preset pivot angle between the inactive position on the roof and the position of the folding arm 45 shown in FIG. 3, a kind of control cable 61 is activated, as a result of which the pawl 35 connected to the control cable is pivoted against spring force, such that the pawl 35 is moved away from the corner pin 31 in question, so that the corner pin 31 is unlocked.

Once all the corner pins 31 have been unlocked, which is done simultaneously and centrally by pivoting the folding arm 45 by means of the control cables 61, the longitudinal side walls 7, 9 can hinge relative to the floor panel 3 and the roof panel 5 via the corner pins 31. In total, eight corner pins located in or near the (inner) corners of the freight container are unlocked simultaneously.

The folding cable 55 connected to the folding arm 45 is preferably split into four corner pin pivoting cables 71 via a guide system 70 comprising rollers, a bearing-mounted tube, etc. Each corner pin pivoting cable 71 is connected to one of the upper corner pins 31, i.e. the four corner pins 31 in the corners of the freight container 1 between the roof panel 5 and the longitudinal side walls 7, 9.

After the folding arm 45 has been pivoted to the position of the folding arm 45 shown in FIG. 3 by means of a hook (not shown) hooked into the eye 51, the body 48 is moved upwards relative to the U-shape 59 by moving the hook that is hooked into the eye 51 further upwards, as a result of which the connecting means connected to the body 48, which comprise the folding cable 55 and the corner pin pivoting cables 71, are tensioned and moved in a direction such that the upper corner pins 31 will pivot about the pivot pin 81 (FIG. 4) in a direction corresponding to the arrow P1 for the corner pin 31 shown in larger-scale view in FIG. 4. At least the upper part of the freight container 1, i.e. the longitudinal side walls 7, 9, the end walls 25 and the roof panel 5, is carried by the folding cable 55 during pivoting of the corner pins 31. Practically immediately after the pivoting of the upper corner pins 31 has started, or even simultaneously therewith, the lower four unlocked corner pins 31, as well as the piano hinges 19, 21, will pivot about the respective pivot pins 81 and the hinge axes 18, 20 under the influence of the weight of the freight container 1. The freight container 1 will now be folded to the fully collapsed position shown in FIG. 2*c* via the step shown in FIG. 2*b*. Once the freight container 1 is fully collapsed, the folding arm 45 can be pivoted back about the pivot pin 44 to the position in which it lies on the roof 5.

To fold out the freight container 1 to the expanded position, the extension arm 47 (see FIGS. 5 and 6) is pivoted upwards about the pivot pin 46. Via connecting means comprising the extension cable 57 as well as corner pin pivoting cables 85 connected thereto via the guide system 90, each upper corner pin 31 is pivoted in a direction corresponding to the arrow P2 for the corner pin 31 shown in larger-scale view in FIG. 5 by means of the hook of a lifting mechanism connected to the eye 53 of the extension arm 47. The corner pin pivoting cables 85 used for folding out the freight container to the expanded position are not the same cables as the corner pin pivoting cables 71 used for folding the freight container to the collapsed position. The lifting mechanism carries the parts of the freight container 1 that are to be unfolded and moves said parts upwards, during which movement the other corner pins 31 as well as the piano hinges 19, 21 are automatically pivoted. Via the step shown in FIG. 2*c*, the freight container 1 is folded out to the expanded position shown in FIG. 2*a* and FIG. 6.

The recesses 37 of the pawls 35 automatically snap over the projections 39 of the corner pins 31 under the influence of spring force when the freight container is moved to the expanded position, as a result of which the corner pins 31 are automatically locked. Accordingly, a locking mechanism to be actively operated is not needed in the illustrated embodiment.

The two separate guide systems 70, 90 centrally split the folding cable 55 and the extension cable 57 each into at least four corner pin pivoting cables 71, 85 and guide said cables to the corners.

The folding arm and the extension arm can preferably be clearly distinguished from each other by an operator.

It is also possible to exchange the cables shown and described herein for a linkage system in the freight container according to the present invention.

The invention claimed is:

1. A collapsible freight container comprising a floor panel, a roof panel as well as two longitudinal side walls connected to the floor panel and the roof panel, each longitudinal side wall comprising a first and a second part, which are connected by means of at least one hinged joint, such that the first part can hinge towards the second part of the same longitudinal side wall about a hinge axis extending in the longitudinal direction of the freight container, wherein each corner of the freight container is provided with at least one corner pin, which corner pins can be moved simultaneously, using an unlocking mechanism located on the roof panel, from a locked position, in which the longitudinal side walls are rigidly connected to the roof panel and the floor panel of the freight container by means of said corner pins, to an unlocked position, in which the longitudinal side walls are hinged to the roof panel and the floor panel of the freight container.

2. A freight container according to claim 1, wherein one of the side walls includes a sectional door, which can be moved from a position in which it extends substantially transversely to the roof panel in the closed position of the freight container to a position in which it extends substantially parallel to the roof panel in the open position of the freight container.

3. A freight container according to claim 1, wherein the unlocking mechanism is provided with a folding arm for folding the freight container to the collapsed position, which folding arm is pivot-mounted to the roof panel of the freight container and which, by pivoting through a predetermined acute angle, can move the corner pins from the locked position to the unlocked position.

4. A freight container according to claim 3, wherein the folding arm is connected via connecting means to at least the upper corner pins that connect the roof panel to the longitudinal side walls, which upper corner pins can be pivoted by means of the folding arm from the position they take up in the locked position to a folding position, in which folding position the freight container is at least partially collapsed.

5. A freight container according to claim 1, wherein the freight container is furthermore provided with an extension arm on the roof panel of the freight container, which extension arm is connected at least to the upper corner pins via connecting means, which upper corner pins connect the roof panel to the longitudinal side walls, whilst the upper corner pins can be pivoted by means of the extension arm from a folding position, in which folding position the freight container is at least partially collapsed, to the locked position.

6. A freight container according to claim 3, wherein the folding arm or an extension arm disposed on the roof panel can be engaged by means of a lifting mechanism, for example a hook of a fork-lift truck or a crane.

7. A freight container according to claim 1, wherein the unlocking mechanism is provided with locking pawls which are movable against spring force for locking the corner pins, which pawls can be moved against said spring force for unlocking the corner pins.

8. A freight container according to claim 1, wherein the freight container is made of a composite material.

9. A freight container according to claim 2, wherein the unlocking mechanism is provided with a folding arm for folding the freight container to the collapsed position, which folding arm is pivot-mounted to the roof panel of the freight container and which, by pivoting through a predetermined acute angle, can move the corner pins from the locked position to the unlocked position.

10. A freight container according to claim 2, wherein the freight container is furthermore provided with an extension arm on the roof panel of the freight container, which extension arm is connected at least to the upper corner pins via connecting means, which upper corner pins connect the roof panel to the longitudinal side walls, whilst the upper corner pins can be pivoted by means of the extension arm from a folding position, in which folding position the freight container is at least partially collapsed, to the locked position.

11. A freight container according to claim 3, wherein the freight container is furthermore provided with an extension arm on the roof panel of the freight container, which extension arm is connected at least to the upper corner pins via connecting means, which upper corner pins connect the roof panel to the longitudinal side walls, whilst the upper corner pins can be pivoted by means of the extension arm from a folding position, in which folding position the freight container is at least partially collapsed, to the locked position.

12. A freight container according to claim 4, wherein the freight container is furthermore provided with an extension arm on the roof panel of the freight container, which extension arm is connected at least to the upper corner pins via connecting means, which upper corner pins connect the roof panel to the longitudinal side walls, whilst the upper corner pins can be pivoted by means of the extension arm from a folding position, in which folding position the freight container is at least partially collapsed, to the locked position.

13. A freight container according to claim 4, wherein the folding arm or an extension arm disposed on the roof panel can be engaged by means of a lifting mechanism.

14. A freight container according to claim 5, wherein a folding arm or the extension arm disposed on the roof panel can be engaged by means of a lifting mechanism.

15. A freight container according to claim 2, wherein the unlocking mechanism is provided with locking pawls which are movable against spring force for locking the corner pins, which pawls can be moved against said spring force for unlocking the corner pins.

16. A freight container according to claim 3, wherein the unlocking mechanism is provided with locking pawls which are movable against spring force for locking the corner pins, which pawls can be moved against said spring force for unlocking the corner pins.

17. A freight container according to claim 4, wherein the unlocking mechanism is provided with locking pawls which are movable against spring force for locking the corner pins, which pawls can be moved against said spring force for unlocking the corner pins.

18. A freight container according to claim 5, wherein the unlocking mechanism is provided with locking pawls which are movable against spring force for locking the corner pins, which pawls can be moved against said spring force for unlocking the corner pins.

19. A freight container according to claim 6, wherein the unlocking mechanism is provided with locking pawls which are movable against spring force for locking the corner pins, which pawls can be moved against said spring force for unlocking the corner pins.

20. A collapsible freight container comprising a floor panel, a roof panel as well as two longitudinal side walls connected to the floor panel and the roof panel, each longitudinal side wall comprising a first and a second part, which are connected by at least one hinged joint, such that the first part can hinge towards the second part of the same longitudinal side wall about a hinge axis extending in the longitudinal direction of the freight container, wherein each corner of the freight container is provided with at least one corner pin, which corner pins can be moved simultaneously, using an unlocking mechanism centrally located on the container, from a locked position, in which the longitudinal side walls are rigidly connected to the roof panel and the floor panel of the freight container said corner pins, to an unlocked position, in which the longitudinal side walls are hinged to the roof panel and the floor panel of the freight container.

* * * * *